United States Patent [19]

Gangloff

[11] Patent Number: 4,945,946

[45] Date of Patent: Aug. 7, 1990

[54] VALVE SEAT FOR A PLATE-TYPE, FLUID-CONTROL VALVE

[75] Inventor: Brian E. Gangloff, Fairport, N.Y.

[73] Assignee: Dresser-Rand Company, Corning, N.Y.

[21] Appl. No.: 459,494

[22] Filed: Jan. 2, 1990

[51] Int. Cl.[5] ..... F16K 15/00

[52] U.S. Cl. ..... 137/516.13; 137/516.15; 137/516.11

[58] Field of Search ..... 137/516.11, 516.13, 137/516.15, 516.17, 516.19, 516.21, 516.23

[56] References Cited

U.S. PATENT DOCUMENTS

| | | | |
|---|---|---|---|
| 2,390,527 | 12/1945 | Flint | 137/516.23 |
| 2,506,306 | 5/1950 | Mantle | 137/516.15 |
| 2,804,086 | 8/1957 | Johnston | 137/516.23 X |
| 3,037,523 | 6/1962 | Szaniszlo | 137/516.23 X |
| 3,175,577 | 3/1965 | King | 137/516.21 X |
| 3,428,081 | 2/1969 | Kauffman et al. | 137/516.21 |
| 4,398,559 | 8/1983 | Bunn et al. | 137/516.15 |

*Primary Examiner*—John Rivell

*Attorney, Agent, or Firm*—Bernard J. Murphy

[57] ABSTRACT

In lieu of the customary concentric annuli upon which to receive a ported valving plate, the seat has a plurality of lands at a common radial distance inwardly from the periphery thereof. The separations between the lands, circumferentially, define additional, fluid flow paths which increase the efficiency of the plate valve in which the seat is employed. Too, as the lands are circumferentially non-continuous, unlike the known, concentric annuli, surface-tension adhesion of the ported, valving plate is greatly minimized.

8 Claims, 1 Drawing Sheet

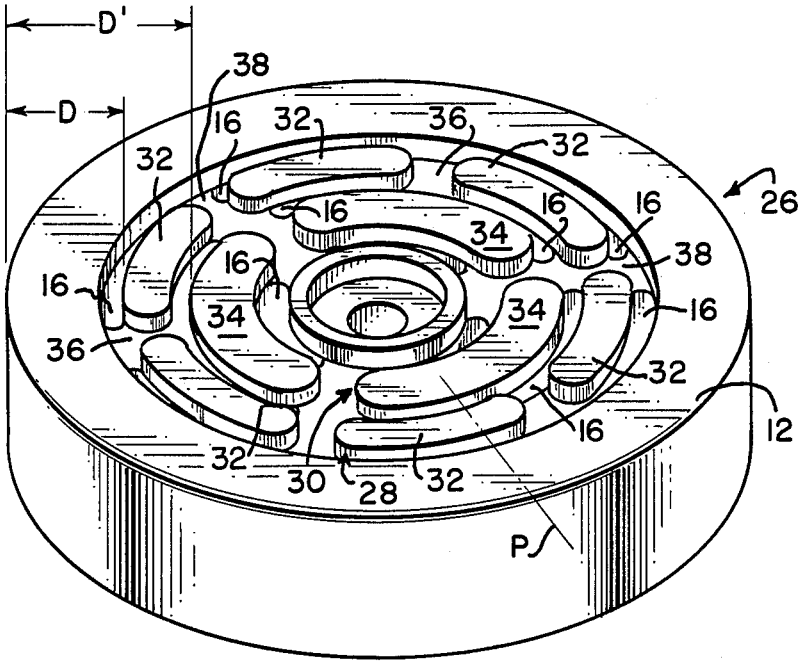
FIG. 2
FIG. 1
PRIOR ART
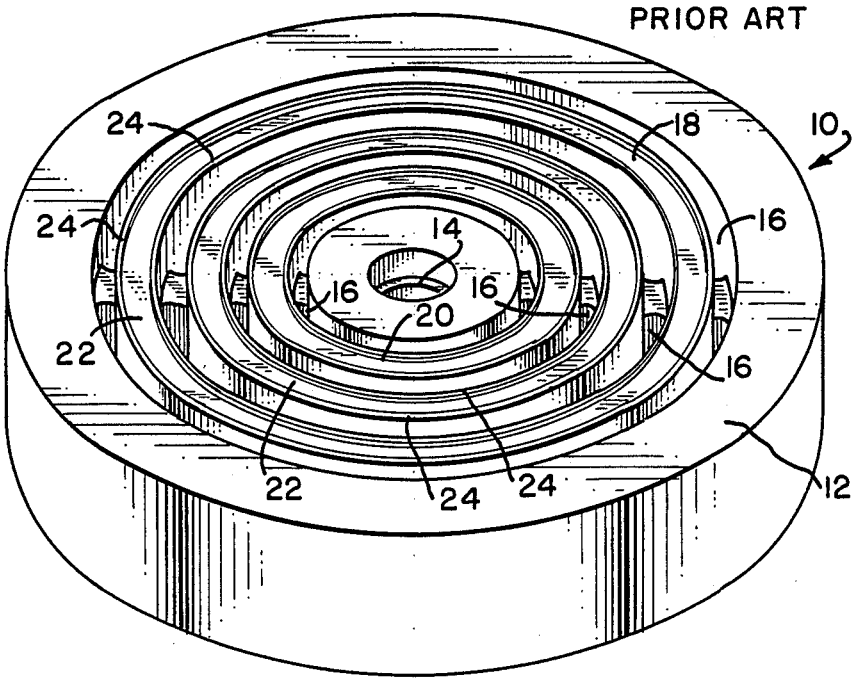

VALVE SEAT FOR A PLATE-TYPE, FLUID-CONTROL VALVE

This invention pertains to plate-type, fluid control valves, generally, and in particular to a novel valve seat for such valves.

In the prior art, valve seats, in plate type, fluid control valves, have concentric annuli upon which to receive the ported, valving plate. Now, to inhibit an undesirable surface-tension adhesion of the valving plate to the seat, the annuli are grooved; this leaves narrow ribs for the valving plate to set upon. Such valve seats are shown in U.S. Pat. Nos. 4,627,464 and 4,643,220, both issued to Kevin Hartshorn, on Dec. 9, 1986 and Feb. 17, 1987, respectively, for "Unidirectional Fluid Control Valve", as both are titled.

The seating of the valving plate upon the ribs, generally, has the desired effect of minimizing the adhesion of the plate to the seat. However, the annuli define fully circumferential walls which, consequently, inhibit fluid flow. Too, there is some not inconsiderable expense in having to groove and rib the annuli.

It is an object of this invention to set forth a novel valve seat in which there is no need to undergo the expense of grooving and forming ribs on annuli. Too, it is an object of this invention to disclose an inventive valve seat devoid of annuli for valve plate seating, and which, consequently, provides a more efficient fluid control valve.

It is a particular object of this invention to set forth a valve seat, for a plate-type, fluid-control valve, comprising a body; said body having (a) an outer periphery, (b) a plurality of throughgoing ports formed therein, and (c) at least a first plurality of lands at a common radial distance inwardly from said periphery.

It is also an object of this invention to disclose a valve seat, for a plate-type, fluid-control valve, comprising a body upon which to receive a ported, valving plate; said body having (a) an outer periphery, (b) a plurality of throughgoing ports formed therein, and (c) a plurality of discrete means, at a common, radial distance inwardly from said periphery, for seating a ported, valving plate thereupon and for inhibiting surface-tension adhesion of such plate thereto.

Further objects of this invention, as well as the novel features thereof, will become more apparent by reference to the following description, taken in conjunction with the accompanying figures, in which:

FIG. 1 is a perspective view of a prior art valve seat; and

FIG. 2 is a perspective view of a valve seat according to an embodiment of the invention.

As shown in FIG. 1, a typical, prior art valve seat 10 has a circumferential wall 12, a center hole 14 for an assembly bolt, a plurality of ports 16 for the conduct of fluid (gas) therethrough, and a plurality of concentric annuli 18, 20, upon which to seat a valving plate.

To avoid adhesion of the valving plate thereto, the annuli 18, 20, have grooves 22 formed in the valving plate confronting surface. As a consequence thereof, concentric ribs 24 remain for the seating of the valving plate (not shown). In that the ribs 24 are quite thin, the valving plate does not readily adhere to them. However, as noted earlier, it is not inexpensive to have to machine such grooves 22 and ribs 24. And again, as the annuli 18, 20, are fully circular, they present walls which inhibit access of the subject fluid (gas) to ports formed in the valving plate.

The novel valve seat 26 of FIG. 2, the same being an embodiment of the invention, has a same circumferential wall 12, and assembly bolt hole 14. Too, it has a same plurality of ports 16. It has no concentric annuli, however. Rather, it has first and second pluralities 28, 30, of discrete lands 32, 34. The lands, in this embodiment, are substantially kindney-shaped; i.e., each occupies an arc of a circle. For being discrete, the lands 32,34, define radial, fluid flow paths 36 and 38 between adjacent ends of each. These paths 36 and 38 significantly improve the efficiency of plate-type valves in which the seat 26 is employed.

Valve efficiency is measured by its effective flow area (EFA). Tests with the novel valve seat 26, in a plate-type valve, increased the EFA of the test valve by six percent. The use of the inventive seat 26 raised the efficiency of the test valve from an EFA of 2.85 in.$^2$ to 3.02 in.$^2$. The voids between the lands 32, 34, which define the additional flow paths 36 and 38, gives the subject fluid better access to the ports in the related valving plate, and afford the fluid a greater flow area.

It is found that there is no need to groove the lands 32, 34, in that the circumferential interruptions therebetween inhibit the formation of surface tension adhesion. Expensive and time-consuming machining of the lands 32, 34, therefore is not necessary. The valving plate confronting surfaces of the lands 32, 34, lie in the same plane "P" as the corresponding surface of the wall 12. As is probably evident in FIG. 2, each of the lands 32 of the first plurality 28 thereof, are at a common, radial distance "D" from the outer periphery of the seat 26. Similarly, the lands 34 of the second plurality 30 thereof, are at a common, radial distance "D" from the aforesaid periphery.

While I have described my invention in connection with a specific embodiment thereof, it is to be clearly understood that this is done only by way of example, and not as a limitation to the scope of my invention as set forth in the objects thereof and in the appended claims.

I claim:

1. A valve seat, for a plate-type, fluid-control valve, comprising:

a body; wherein said body has (a) an outer periphery, (b) a first plurality of throughgoing ports formed therein at a first radial distance inwardly from said periphery, (c) a second plurality of throughgoing ports formed therein at a second radial distance inwardly from said periphery, and (d) at least a first plurality of lands at a common radial distance inwardly from said periphery; and adjacent lands, of said plurality thereof, define flow paths therebetween which are in open communication with ports in said first and second pluralities of ports.

2. A valve seat, according to claim 1, wherein:

said lands are substantially kidney-shaped.

3. A valve seat, according to claim 1, wherein:

each of said lands is interposed between a pair of said ports.

4. A valve seat, according to claim 1, wherein:

said body further has a peripheral wall;

said wall has a surface lying in a given plane; and each of said lands has an uninterrupted, planar surface which lies in said given plane.

5. A valve seat, for a plate-type, fluid-control valve, comprising:

a body; wherein said body has (a) an outer periphery, (b) first and second pluralities of throughgoing ports formed therein at first and second radial distances inwardly from said periphery, (c) a first plurality of lands at a first, common, radial distance inwardly from said periphery, and (d) a second plurality of lands at a second, common, radial distance inwardly from said periphery; and adjacent lands of said first plurality thereof cooperate with adjacent lands of said second plurality thereof to define fluid flow paths therebetween which are in open communication with ports in said first and second pluralities of ports.

6. A valve seat, according to claim 5, wherein:

each of said lands occupies an arc of a circle.

7. A valve seat, according to claim 5, wherein:

each of said lands is separated, radially, from another thereof by one of said ports.

8. A valve seat, according to claim 5, wherein:

said body further has a peripheral wall;

said wall has a surface lying in a given plane; and each of said lands has an uninterrupted, planar surface which lies in said given plane.

* * * * *